United States Patent [19]

McFarlane et al.

[11] Patent Number: 4,649,587

[45] Date of Patent: Mar. 17, 1987

[54] PICKABACK BRIDGE SPANS FOR USE WITH AN INVERSION-LAUNCH BRIDGELAYER

[75] Inventors: Norman D. McFarlane, Christchurch; John T. Glock, Wimborne; John G. Hambly, Christchurch, all of England

[73] Assignee: The Secretary of State for Defence in Her Britannic Majesty's Government of the United Kingdom of Great Britain and Northern Ireland, London, England

[21] Appl. No.: 763,259

[22] Filed: Aug. 7, 1985

[30] Foreign Application Priority Data

Aug. 24, 1984 [GB] United Kingdom ..... 8421616

[51] Int. Cl.[4] ..... E01D 15/12

[52] U.S. Cl. ..... 14/2.4; 14/71.3; 14/71.7

[58] Field of Search ..... 14/1, 2.4, 71.3, 71.7

[56] References Cited

U.S. PATENT DOCUMENTS 4,411,036 10/1983 Fitzgerald-Smith ..... 14/2.4

4,510,637 4/1985 Zlotnicki ..... 14/2.4

*Primary Examiner*—Stephen J. Novosad

*Assistant Examiner*—Thomas J. Odar

*Attorney, Agent, or Firm*—Stevens, Davis, Miller & Mosher

[57] ABSTRACT

A bridge span is provided with coupling means enabling two spans to be carried jointly in pickaback fashion on an inversion-launch bridgelayer and launched separately therefrom without exposure of personnel.

The launch system requires no modification to the bridgelayer.

9 Claims, 8 Drawing Figures

Figure 4:
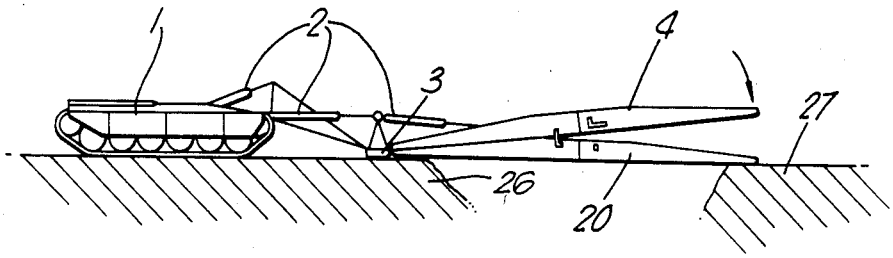

Fig. 1.
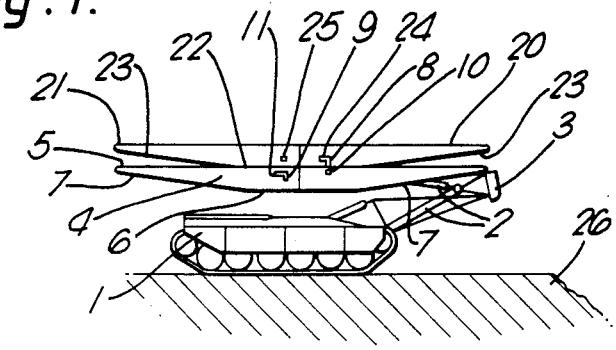
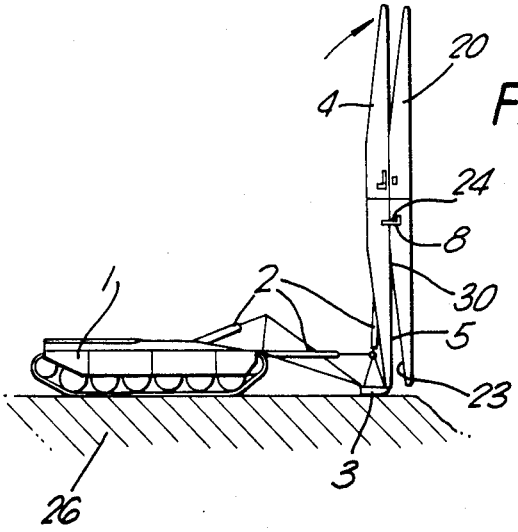
Fig. 2.
Fig. 3.
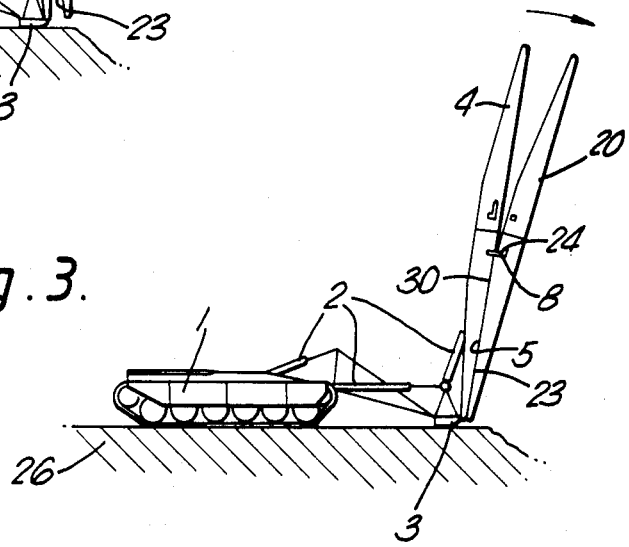

4
5
6
7
20
22
23
24
25
30
40
41
42
43
44
45
46
47
48
49
50
51
52
60
61
62
63
64
65
8
9

PICKABACK BRIDGE SPANS FOR USE WITH AN INVERSION-LAUNCH BRIDGELAYER

This invention relates to bridge spans suitable for carriage two at a time in pickaback fashion upon a bridgelayer and for launch singly therefrom, the bridgelayer being of conventional inversion-launch type, ie one in which a span is rotated upwards and over one of its ends. Such bridgelayers are commonly used in a scissors-launch mode, in which a first and second bridge span, hinged end to end and folded one on top of the other are conjointly launched by rotation of the hinge end upwards and over the other end of the first span, the second span being simultaneously unfolded from the first by a scissoring action at the hinge, thereby to extend into a bridge of double span length.

When gaps in a terrain of interest are small enough to be bridged by a single span length, inversion-launch bridgelayers capable of carrying a double span for scissors launch are frequently used to carry and launch a single span only. This is clearly an inefficient use of resources when the bridgelayer is capable of transporting two separate spans one on top of the other, ie pickaback, if only they could be launched singly. The present invention seeks to provide pickaback bridge spans that can be transported in pairs and launched separately from a single bridgelayer, without exposure of personnel.

In accordance with the present invention a bridge span having a top chord face and an opposed parallel bottom chord face, includes a first and second coupling member located adjacent the top chord face and the bottom chord face respectively, the second coupling member of a first of said spans being engageable with the first coupling member of an identical second of said spans having its top chord face disposed contiguous with the bottom chord face of the first span, maintenance of engagement between the first and second coupling members being controlled, in use, by the weight distribution of the second span relative to the first span.

When two of said bridge spans are to be carried pickaback and separately launched by an inversion-launch bridgelayer, the first span is attached with its bottom chord face uppermost in conventional manner to the bridgelayer. The second span may then be stacked, also with its bottom chord face uppermost, superjacent the first span and their co-operative first and second coupling members engaged. The two spans can then be inverted conjointly by the bridgelayer until the bottom chord face of the second span engages the banks of a gap to be bridged, whereupon the coupling members disengage, leaving the second span emplaced and the first span still attached to the bridgelayer for recovery and later deployment elsewhere.

The provision of both the first and the second coupling members on each span permits either span to be used as the first or the second span.

Preferably the first coupling member comprises a pin transversely protrusive from the span along a first axis parallel to the top chord face, the second coupling member being a hook pivotable about a second axis transverse to the span and parallel with the bottom chord face, the hook being engageable with the pin of the superjacent second span.

Conveniently, the hook is configured to allow horizontal withdrawal of the hook from the pin when the second span has its bottom chord face engaged with the ground and its weight supported thereon, thereby permitting disengagement of the coupling members by the simple expedient of backing off the first span with the bridgelayer.

Preferably the first and the second coupling means are each provided in duplicate, symmetrically disposed about the centre line of the length of each span so as to permit launch and retrieval by inversion over either end of the span.

Figure 7:
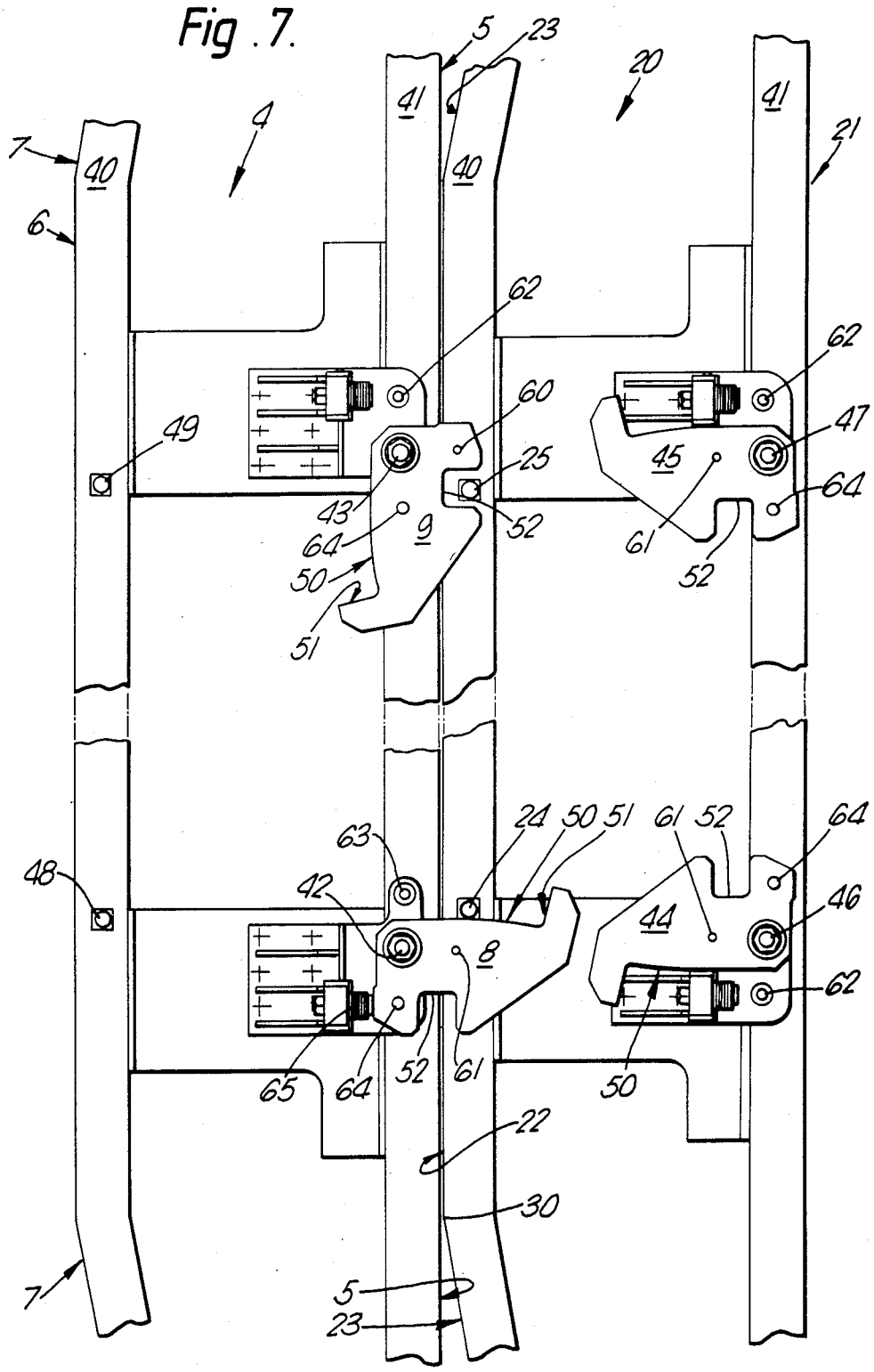
Figure 8:
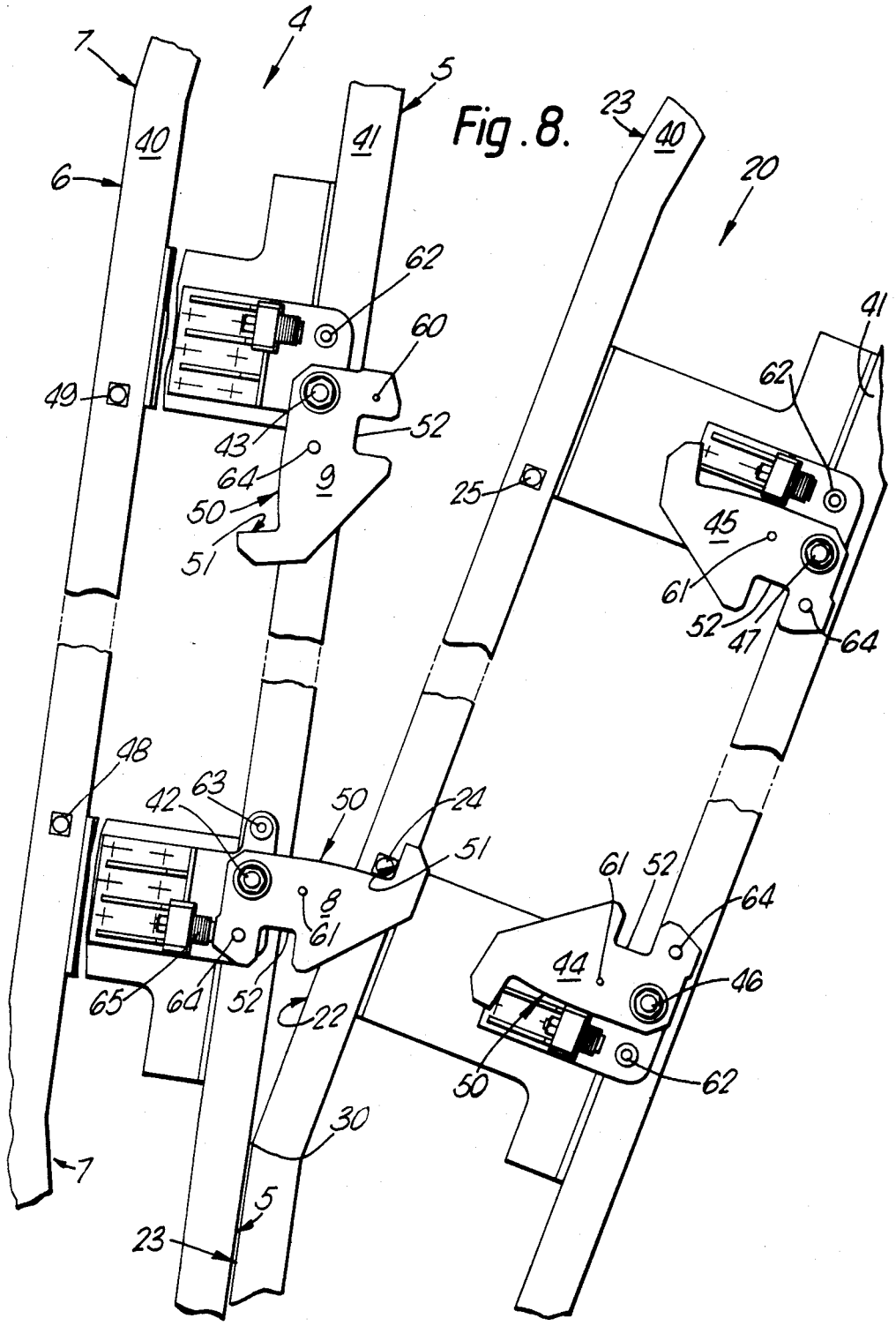

An embodiment of the invention will now be described by way of example only, with reference to the accompanying drawings of which:

FIGS. 1 to 6 are diagrammatic side views of a bridgelayer carrying two bridge spans pickaback, sequentially illustrating launch of the top one of the spans, and FIGS. 7 and 8 are detailed views of a coupling member arrangement suitable for the same two spans, and drawn in the relative span dispositions of FIG. 2 and FIG. 3 respectively.

FIG. 1 depicts an inversion-launch bridgelayer 1 having a conventional arrangement of inversion jacks 2 and a launch pad 3, and carrying a first bridge span 4 attached for launch, which span has a bottom chord face 5, a parallel top chord face 6 and two tapering end-ramp top chord faces 7. A mirror-imaged pair of first coupling members comprised by hooks 8 and 9 each rotatable about respective axes 10 and 11 are located equidistant from the centre of the span length, the axes being adjacent and parallel to the bottom chord face 5 with an orientation transverse to the span length.

Superimposed on the span 4 is a second bridge span 20 having a bottom chord face 21, a parallel top chord face 22, two end-ramp top chord faces 23, and two second coupling members comprised by pins 24 and 25 disposed adjacent and parallel to the top chord face 22 so as to be respectively engagable by the hooks 8 and 9 of the first span 4.

For launch purposes, only the hook and pin nearest to the end over which the span is to be inverted are interconnected, i.e. the hook 8 and the pin 24 as drawn, the other hook 9 and pin 25 being provided for interconnection when the spans are loaded in the reverse direction upon the bridgelayer. Identical pairs of hooks 8 and 9 and pins 24 and 25 are additionally provided (but not shown) adjacent the bottom chord face 21 and the top chord face 6 of the two spans 20 and 4 respectively, so as to permit stacking of the spans in reverse order.

A second parallel stack of spans 4 and 20 is carried by the bridgelayer 1, (not seen in side view) each lateral pair of spans being cross-connected to provide a twin-trackway span.

In use the bridge layer 1 is advanced to a bank 26 with the hook 8 and the pin 24 engaged for launch and the hook 9 disposed in transit position (to be discussed later with reference to FIG. 7). The two spans are then conjointly inverted by the jacks 2 as shown in FIGS. 2 to 4 until the span 20 is supported on the bank 26 and the far bank 27, whereupon the bridgelayer 1 is backed away to withdraw the hook 8 and the span 20 from the pin 24 (see FIG. 5). The span 4 can then be returned to the bridgelayer (FIG. 6) for transit to another site.

It will be seen from FIG. 3 that once the conjoint spans have been rotated beyond the vertical, the span 20 pivots against the span 4 about an inter-span pivot axis comprised by a bearing edge 30 defined by the transverse line of intersection of the top chord face 22 and the end-ramp top chord face 23, until the face 23 of the span 20 engages the bottom chord face 5 of the span 4, thereby permitting both spans 4 and 20 to pivot against the launch pad 3 for the remainder of the launch. The detailed arrangements of the hooks 8 and 9 and the pins 24 and 25 which enable this action to take place will now be discussed with reference to FIGS. 7 and 8.

FIG. 7 illustrates detail of the central portion of the two spans 4 and 20 relatively disposed as shown in FIGS. 1 and 2. Each span is comprised by a top chord 40 and a bottom chord 41 which chords respectively define the aforesaid parallel top chord faces 6 and 22 and end-ramp top chord faces 7 and 23, and the bottom chord faces 5 and 21.

The bottom chord 41 of the span 4 pivotally supports the aforesaid mirror-imaged two hooks 8 and 9 at stub axles 42 and 43 respectively, a similar pair of hooks 44 and 45 being shown attached to the bottom chords 41 of the span 20 at stub axles 46 and 47 respectively. The top chords 40 of the spans 20 and 4 respectively support the aforesaid pair of pins 24 and 25, and a similar pair of pins 48 and 49.

Each hook 8, 9, 44 and 45 is comprised by a flat plate having a radiused first bearing edge 50, and an end-capture, second bearing edge 51 perpendicular to the edge 50, and a notch 52 disposed in opposition to the first bearing edge 50. Each hook is further provided with two through holes 60 and 61 equidistant from the respective stub axle 42 43 46 or 47, either one of the holes 60 and 61 being alignable with either one of two sockets 62 and 63 also equidistantly located at either side of the respective stub axle in the bottom chord 41 so as conjointly to permit insertion of a locking pin 64, thereby to secure the hook in any one of three positions, namely, a launch position as illustrated for the hook 8, a transit position as illustrated for the hook 9 and a stowage position as illustrated for both the hooks 44 and 45.

The dispositions of the locking pins 64 shown for all four hooks in FIG. 7 is the disposition employed throughout the whole of the transit, launch and recovery sequence illustrated in FIGS. 1 to 6, the redundant hooks 44 and 45 being locked safely out of the way in the stowage position, active hook 9 being engagable with the pin 25 at the notch 52, and active hook 8 being engagable with the pin 24 at the first bearing edge 50 or at the second bearing edge 51 (see FIG. 8).

The specific engagements of the hooks 8 and 9 illustrated in FIG. 7 endure throughout transit and the launch sequence from FIG. 1 to FIG. 2, the hook 9 preventing relative longitudinal movement of the two spans, and the hook 8 bearing the load of the span 20 via the pin 24 once inversion has commenced. As soon as the conjoint spans have been rotated beyond the vertical, as shown in FIGS. 3 and 8, the span 20 pivots about the bearing edge 30 until its end-ramp top chord face 23 engages with the bottom chord face 5 of the span 4, the pin 25 disengaging from the notch 52 of the hook 9 and the pin 24 sliding outwardly along the first bearing edge 50 of the hook 8 to come to rest against the end-capture, second bearing edge 51 (see FIG. 8). The shock of engagement between the faces 23 and 5, and of the end-capture of the pin 24, is absorbed by a stack of disc springs 65 compressible between the hook 8 and the span 4, the hole 60 in the hook 8 being of sufficiently larger diameter than the locking pin 64 to allow freedom for this compression.

Figure 5:
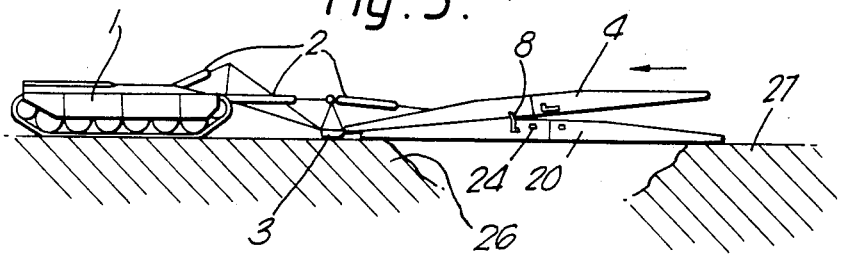
Figure 6:
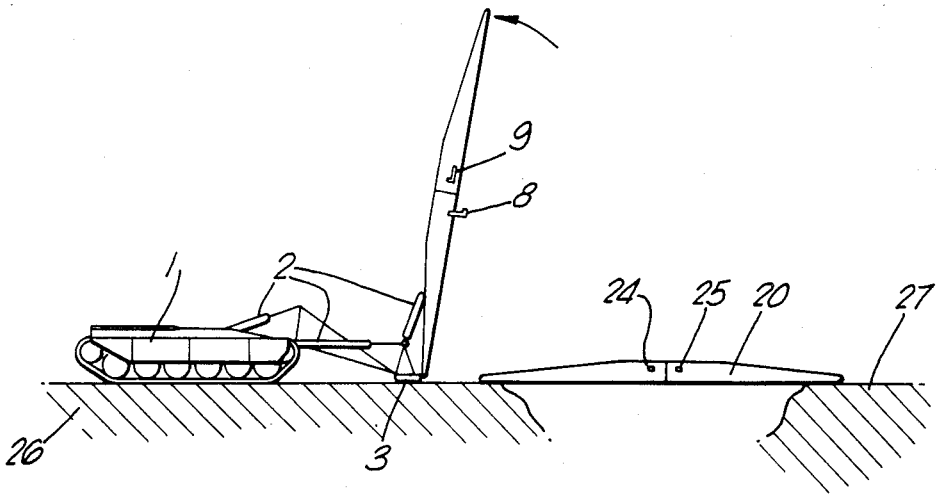

The two spans thereafter maintain this relative disposition throughout the remainder of the launch until the weight of the span 20 is supported upon the ground. The hook 8 may then be withdrawn from engagement with the pin 24 by backing off the span 4 with the bridgelayer 1 (FIG. 5).

The span 4 is then returned to the bridgelayer 1 (FIG. 6) for use elsewhere. Retrieval of the span 20 is accomplished by a reverse procedure and may take place from either end.

This embodiment of the invention is advantageous in requiring no modifications to the bridgelayer, no additional interface with the driver of the bridgelayer and no exposure of personnel throughout deployment and recovery.

We claim:

1. A first bridge span for pickaback loading and launch with a substantially identical second bridge span, said first bridge span comprising a top chord face and an opposed parallel bottom chord face and including a first and a second coupling member located adjacent the top chord face and the bottom chord face respectively, the second coupling member of said first span being adapted to engage with a first coupling member of said second span when said second span has its top chord face disposed contiguous with the bottom chord face of the first span, said second span having a weight distribution relative to said first span for maintaining engagement between said second coupling member of said first span and said first coupling member of said second span during use.

2. A bridge span as claimed in claim 1 wherein the first and the second coupling members of the first span are each provided in duplicate and are symmetrically disposed about the center line of the length of the first span.

3. A bridge span as claimed in claim 1 wherein said first coupling member of the first span comprises a pin transversely protrusive from the span along a first axis parallel to the top and bottom chord faces and said second coupling member of the first span comprises a hook pivotable about a second axis parallel with the first axis so as to be arcuately engageable with the pin of an adjacent span, the hook being provided with a launch-position locking means for maintaining the said arcuate engagement.

4. A bridge span as claimed in claim 3 wherein said hook has a first bearing edge extending substantially radially from the said second axis, and a second bearing edge extending substantially perpendicularly thereto, the two edges in use engaging sequentially with the pin of the said second span, as said first span is rotated upwardly over one of its ends from a substantially horizontal disposition with its bottom chord face uppermost to a substantially horizontal disposition with its top chord face uppermost.

5. A bridge span as claimed in claim 4 wherein said top chord face of the first span has an end-ramp portion extending beyond said pin and tapering towards said bottom chord face, said portion defining at its intersection with the top chord face of the first span an inter-span pivot axis; and said first bearing edge of the hook is provided with an arcuate profile centered on said inter-span pivot axis.

6. A bridge span as claimed in claim 5 wherein a shock absorbing means is provided interjacent said hook and its respective span, disposed for absorbing shocks in a direction arcuate about the said second axis.

7. A bridge span as claimed in claim 4 wherein said hook is further provided with a notch disposed in back-to-back relationship with the first bearing edge, which notch is alternatively arcuately engageable with the said pin, the hook being provided with a transit-position locking means for maintaining the said alternative engagement.

8. A bridge span as claimed in claim 4 wherein said hook is further provided with a stowage-position locking means for maintaining the hook non-protrusive from the bottom chord face.

9. A method of pickaback loading and separately launching a first and a second bridge span from an inversion-launch bridgelayer; the two spans each having a top chord face provided with a pair of transversely projecting pins symmetrically disposed about the centre line of the span length, and a bottom chord face provided with a pair of correspondingly disposed hooks each rotatable about an axis parallel with the pin axes and each having a first bearing face locatable to face towards said centre line and a notch disposed in back-to-back relationship with the first bearing face; comprising the steps of:

(a) loading the first span onto the bridgelayer, disposed with its bottom chord face uppermost and located so as to be invertable over one end adjacent a launch pad, (b) loading the second span on top of the first span, with its top chord face disposed contiguous with the bottom chord face of said first span, (c) engaging each of said two hooks of the first span with the adjacent pins of the second span, the hook nearest to the launch pad being locked into engagement at its first bearing edge by a launch-position locking means and the hook furthest from the launch pad being locked into engagement at its notch by a transit-position locking means, (d) securing the two hooks of the second span so as to be non-protrusive from the bottom chord face, by a stowage-position locking means, (e) advancing the bridgelayer to a deployment site, (f) inversion-launching both spans together by rotation of the first span over the launch pad until the bottom chord face of the second span is supported upon the ground, (g) withdrawing the first span from the second span in a substantially horizontal direction by backing-off the bridgelayer, (h) recovering the first span onto the bridgelayer by reinversion about the launch pad, for subsequent deployment at a further site.

* * * * *